United States Patent [19]

King

[11] Patent Number: 4,742,438

[45] Date of Patent: May 3, 1988

[54] PURSE LIGHT

[75] Inventor: Tabitha S. King, Bangor, Me.

[73] Assignee: LumenAries, Inc., Plano, Tex.

[21] Appl. No.: 21,987

[22] Filed: Mar. 5, 1987

[51] Int. Cl.[4] ..... A45C 15/06

[52] U.S. Cl. ..... 362/156; 362/137

[58] Field of Search ..... 362/156, 137

[56] References Cited

U.S. PATENT DOCUMENTS

| | | | |
|---|---|---|---|
| 1,184,146 | 5/1916 | Sundh | 362/137 |
| 3,239,658 | 3/1966 | Castaldo | 362/156 |
| 3,808,416 | 4/1974 | Pottratz | 362/156 |
| 4,084,085 | 4/1978 | Kim | 362/156 |
| 4,091,443 | 5/1978 | Ohrenstein et al. | 362/156 |

*Primary Examiner*—E. Rollins Cross

*Attorney, Agent, or Firm*—H. Dennis Kelly

[57] ABSTRACT

A light for the interiors of lady's purses, having a light bulb and an electric power supply, mounted within a translucent housing. The housing is temporarily mounted on a mounting bracket, which is permanently attached to the interior of a purse. The mounting bracket has a pair of tabs, which engage holes in the housing.

5 Claims, 1 Drawing Sheet

PURSE LIGHT

BACKGROUND OF THE INVENTION

1. Field of the Invention

This invention relates in general to the field of ladies' accessories. In particular, the invention relates to lights for the interiors of ladies' purses.

2. Description of the Prior Art

There are many times when a woman needs a light in order to see into her purse. If the purse does not have a built-in light, the lady must use light from an outside source, such as a lamp or a flashlight. It is, of course, much more convenient if the light is mounted in the purse.

There have been lights in purses for many years. Some purses have a convenient lighted mirror for those times when make-up must be repaired. Other purses have lights for illuminating the contents of the purse.

Most women own a variety of purses, so that they can select a purse which coordinates with their clothes. When a lady changes clothes, she often must change purses, too.

Since many ladies own several purses, it could be very expensive to purchase a purse light for each purse. It would be more economical to buy a single purse light, if that light can be moved from one purse to another. However, the light must be moved as easily as the contents of the purse, or the savings will not be worth the trouble of moving the light.

SUMMARY OF THE INVENTION

The light of the invention is designed to be temporarily mounted within a lady's purse. The light can be easily removed from one purse and reinstalled in a different purse.

The light has a light bulb and an electric power supply, contained in a translucent housing. A thumb switch, on top of the housing, is used to turn the light on and off.

The light is mounted on a mounting bracket, which is permanently attached to the interior of the purse. The mounting bracket has a pair of tabs, which engage holes in the housing of the light.

DESCRIPTION OF THE PREFERRED EMBODIMENT

Figure 1:
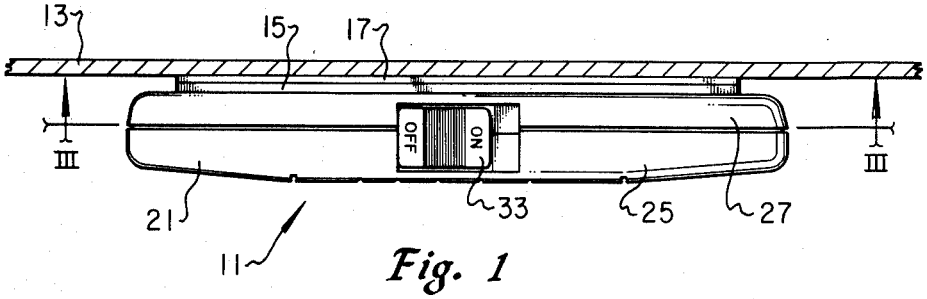
FIG. 1 is a top view of the purse light of the invention.
Figure 2:
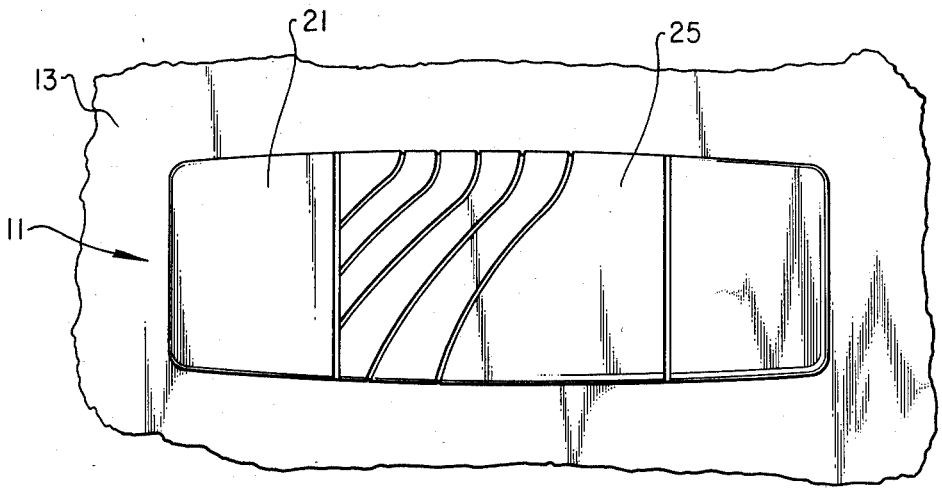
FIG. 2 is a side view of the purse light of the invention.

The invention is a light 11 for a lady's purse 13. The light 11 is temporarily mounted on a mounting bracket 15, which is permanently attached to the interior of the purse 13 by a strip of double-sided tape 17. Similar mounting brackets 15 may be attached to the interiors of other purses 13 in the same manner.

The light 11 has a pair of light bulbs 19, mounted within a housing 21. There are many different types of light bulbs 19 which may be used. The preferred light bulbs 19 are #7313 IEE lamps, which are commercially available. The light bulbs 19 are mounted in conventional lamp holders 23. The preferred lamp holders 23 are #16-77R-19 lamp holders, which are also commercially available.

The housing 21 of the light 11 has two parts: a translucent front 25 and a translucent back 27. The lamp holders 23 are attached to the back 27 of the housing 21, as shown in FIG. 3.

Electricity is supplied to the light bulbs 19 by a pair of AAA batteries 29. The batteries 29 are, of course, replaceable, and are mounted within the housing 21 of the light 11, as shown in FIG. 3. An electric wire 31 connects the batteries 29 and the light bulbs 19.

The light 11 is turned on and off by a thumb switch 33, which is located on the top of the housing 21. The switch 33 can be easily moved to the right, to turn the light 11 on, or to the left, to turn the light 11 off.

Figure 3:
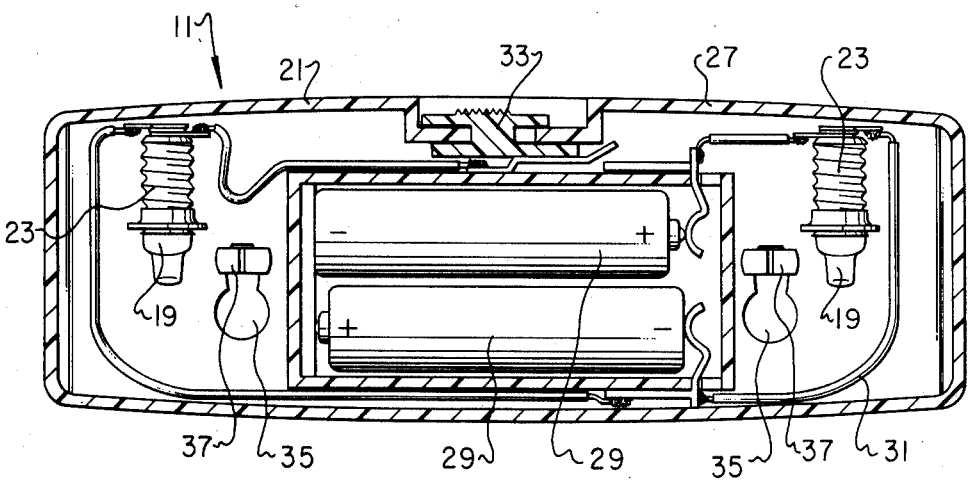
FIG. 3 is a sectional view of the purse light of the invention, as seen along lines III—III in FIG. 1.

As shown in FIG. 3, there are two holes 35 in the back 27 of the housing 21. Each hole 35 is wide at the bottom and narrow at the top, thus generally having a "keyhole" shape.

The mounting bracket 15 has a pair of tabs 37. These tabs 37 are placed so that they will engage the holes 35 in the housing 21 of the light 11. The tabs 37 fit easily through the lower, wider part of the holes 35. However, when the housing 21 is lowered, to place the tabs 37 in the upper, narrow part of the holes 35, the tabs 37 will secure the housing 21 to the mounting bracket 15.

In operation, mounting brackets 15 are permanently taped to the interiors of all the purses 13 that the lady owns. When a particular purse 13 is to be used, the light 11 is installed in that purse 13. The housing 21 is placed on the mounting bracket 15, so that the tabs 37 engage the lower wider part of the holes 35 in the housing 21. The housing 21 is then pushed downward, to move the upper narrow part of the holes 35 down onto the tabs 37. The light 11 will then be securely mounted, while the purse 13 is in use.

When a different purse 13 is to be used, the light 11 can be easily removed from the first purse 13. The housing 21 is raised to move the holes 35 upward relative to the tabs 37. The tabs 37 can then be withdrawn from the holes 35, and the housing 21 can be removed from the mounting bracket 15. The light 11 can then be installed in the new purse 13.

The purse light 11 of the invention has several advantages over the prior art. Since the light 11 can be moved from purse 13 to purse 13, only one light 11 is required. The system requires only a relatively inexpensive mounting bracket 15 for each purse 13. The light 11 can be moved from purse 13 to purse 13, with only a small amount of effort in addition to the usual exchange of contents.

The invention has been shown in only one of its forms. It should be apparent to those skilled in the art that it is not so limited, but is susceptible to various changes and modifications without departing from the spirit thereof.

I claim:

1. A light for the interior of a lady's purse, the light comprising:

a housing, having a translucent front;

a light bulb, mounted within the housing;

a power supply, mounted within the housing, for supplying electrical power to the light bulb;

switch means for turning the light on and off;

a mounting bracket, permanently attached to the interior of the purse; and attachment means for temporarily attaching the housing to the mounting bracket.

2. A light for the interior of a lady's purse, as recited in claim 1, further comprising a plurality of additional mounting brackets, to be attached to the interiors of other purses.

3. A light for the interior of a lady's purse, as recited in claim 1, wherein the attachment means is a pair of holes in the housing and a pair of tabs on the mounting bracket.

4. A light for the interior of a lady's purse, as recited in claim 1, wherein the switch means is a thumb switch located on top of the housing.

5. A light for the interiors of a lady's purses, the light comprising:

a housing, having a translucent front and a translucent back and a pair of holes;

a light bulb, mounted on the back of the housing;

a power supply, mounted within the housing, for supplying electrical power to the light bulb;

a thumb switch, located on top of the housing, for turning the light on and off;

a plurality of mounting brackets, permanently attached to the interiors of a plurality of purses, each mounting bracket having a pair of tabs for engagement with the holes in the housing; and attachment means for temporarily attaching the housing to the mounting bracket.

* * * * *